US009353492B1

(12) United States Patent
Stell et al.

(10) Patent No.: US 9,353,492 B1
(45) Date of Patent: May 31, 2016

(54) PAVEMENT SWEEPER WITH CONVEYOR LIFT OUT DROP IN SYSTEM

(71) Applicant: SCHWARZE INDUSTRIES, Inc., Huntsville, AL (US)

(72) Inventors: Edward B. Stell, New Market, AL (US); John D. Quick, Grant, AL (US); Jodie R. Wallace, Hazel Green, AL (US)

(73) Assignee: Schwarze Industries, Inc., Huntsville, AL (US)

( * ) Notice: Subject to any disclaimer, the term of this patent is extended or adjusted under 35 U.S.C. 154(b) by 120 days.

(21) Appl. No.: 14/252,653

(22) Filed: Apr. 14, 2014

Related U.S. Application Data

(60) Provisional application No. 61/811,795, filed on Apr. 14, 2013.

(51) Int. Cl.
*E01H 1/04* (2006.01)

(52) U.S. Cl.
CPC ..... *E01H 1/042* (2013.01)

(58) Field of Classification Search
CPC ..... E01H 1/04; E01H 1/042; E01H 1/045; E01H 1/047; B65G 13/12; B65G 39/02; B65G 21/06
USPC ..... 15/83–86
See application file for complete search history.

(56) References Cited

U.S. PATENT DOCUMENTS

| | | | |
|---|---|---|---|
| 3,559,894 | A | 2/1971 | Murray et al. |
| 4,106,270 | A | 8/1978 | Weigand et al. |
| 4,164,820 | A | 8/1979 | Krickovich |
| 4,171,551 | A | 10/1979 | Hildebrand et al. |
| 4,222,141 | A | 9/1980 | Kieft et al. |
| 4,271,661 | A | 6/1981 | deBuhr |
| 4,405,089 | A | 9/1983 | Taylor |
| 4,457,044 | A | 7/1984 | Erdman |
| 5,054,152 | A | 10/1991 | Hulicsko |
| 5,060,334 | A | 10/1991 | Strauser et al. |
| 5,251,652 | A | 10/1993 | Strauser et al. |
| 5,361,441 | A | 11/1994 | Williamson |
| 5,596,784 | A | 1/1997 | Tolmachoff |
| 5,797,203 | A | 8/1998 | Vanderlnden |
| 6,142,290 | A | 11/2000 | Tagliaferri |
| 6,195,837 | B1 | 3/2001 | Vanderlinden |
| 6,651,418 | B1 | 11/2003 | McClure et al. |

(Continued)

FOREIGN PATENT DOCUMENTS

DE 202013105493 * 2/2014

*Primary Examiner* — Mark Spisich
(74) *Attorney, Agent, or Firm* — Wallace G. Walter

(57) ABSTRACT

A mechanized broom-type sweeper vehicle (10) includes a conveyer (14) having two laterally extending pintle-like stub shafts (14-5) with the conveyor (14) received in a cradle (20) that includes split pillow blocks that each receive a respective one of the stub shafts (14-5). The conveyor (14) can be readily lifted from the vehicle (10) by removing structures superposed above the conveyor (14), disconnecting various mechanical and electrical connection removing the cap portion of each pillow-block, and thereafter lifting the conveyor (14) from the vehicle with an overhead crane. In a similar manner, a repaired or replacement conveyor (14) can be lowered via a crane into the cradle (20) with the stub shafts received within the pillow blocks and the caps reinstalled. The use of a top-side removal and a top-side installation technique reduces the time (and associated costs) for the removal and replacement of a conveyor (14) to as little as four hours or less.

6 Claims, 8 Drawing Sheets

(56) References Cited

U.S. PATENT DOCUMENTS

| | | | |
|---|---|---|---|
| 6,877,180 | B2 | 4/2005 | Wilmo et al. |
| 7,086,118 | B2 | 8/2006 | Engel et al. |
| 7,150,062 | B2 | 12/2006 | Charky et al. |
| 7,159,706 | B2 | 1/2007 | Wilmo et al. |
| 7,165,628 | B2 | 1/2007 | Taylor et al. |
| 7,281,296 | B2 | 10/2007 | Strauser |
| 7,721,374 | B1 | 5/2010 | Hammack et al. |
| 7,996,955 | B2 | 8/2011 | Byczynski |
| 2003/0229957 | A1 | 12/2003 | Skinner et al. |
| 2004/0045585 | A1 | 3/2004 | Wilmo et al. |
| 2005/0060834 | A1 | 3/2005 | Strauser |
| 2005/0194235 | A1 | 9/2005 | Wilmo et al. |
| 2005/0194236 | A1 | 9/2005 | Wilmo et al. |
| 2006/0249357 | A1 | 11/2006 | Wilmo et al. |
| 2009/0013496 | A1 | 1/2009 | Byczynski |
| 2011/0303240 | A1 | 12/2011 | Bauer |

* cited by examiner

PAVEMENT SWEEPER WITH CONVEYOR LIFT OUT DROP IN SYSTEM

CROSS-REFERENCE TO RELATED APPLICATION

This patent application claims the benefit of commonly owned U.S. Provisional Patent Application 61/811,795 filed Apr. 14, 2013 filed by the inventors herein, the disclosure of which is incorporated herein by reference.

BACKGROUND

The present invention relates to mechanized sweeper vehicles that utilize a primary broom to sweep debris from pavements and roadways and, more particularly, to method and apparatus for removing a conveyor assembly from a sweeper vehicle and installing a replacement conveyor assembly.

Mechanical broom sweepers are designed to pick-up debris not normally accepted by conventional regenerative or vacuum-type sweepers; this debris typically including asphalt nodules of varying size consequent to asphalt milling operations, rocks, stones, broken concrete debris, construction debris, broken bricks and masonry, and the like.

FIG. 1 presents, in side view, a model M5000/M6000 mechanized broom sweeper 10 manufactured by Schwarze Industries, Inc. of Huntsville Ala. and shows a rotatable broom 12 mounted at the aft end of the vehicle. The broom 12 is rotated against the road surface to brush debris in the forward direction onto a mechanical conveyor 14. As shown in FIGS. 2 and 3, the conveyor 14 typically includes a set of parallel flights 14-1 that are connected by a link chain 14-2 to push the debris along an inclined floor pan 14-3 under control of a hydraulic motor 14-4 to carry the debris upwardly for deposit through an entry opening of a debris collection bin or hopper 16. A representative vehicle of this type is also disclosed in U.S. Pat. No. 7,721,374 issued May 25, 2010, entitled "Debris/Load Leveling System," in common assignment herewith, the disclosure of which is incorporated herein by reference.

Typically, conveyors 14 are subject to harsh operating conditions since the debris is both abrasive and often capable of bending and deforming the flights 14-1. As represented in FIG. 4, when a conveyor 14 must be changed, it is necessary to disassemble most the structures aft of the rear axle, including sheet metal housings and their supports, and many brackets, trailing arms, pivots, and the like on both sides of the conveyor 14 to remove the rotary brush 12 and related control structures in order to gain access to and remove the conveyor 14. Often, a broom sweeper vehicle can be 'down' for several days in order to remove and replace a conveyor 14.

SUMMARY

In a mechanized sweeper vehicle, the conveyer includes two laterally extending pintle-like stub shafts; the conveyor is received in a cradle that includes split pillow blocks that each receive a respective one of the stub shafts. The conveyor can be readily lifted from the vehicle by removing structures above and adjacent to the conveyor, disconnecting various pivots, linkages, etc., removing the cap portion of each pillow-block, and lifting the conveyor from the vehicle with an overhead crane. In a similar manner, a replacement conveyor can be lowered via a crane into the cradle with the stub shafts received within the pillow blocks and the caps reinstalled.

The use of a top-side removal and a top-side installation technique reduces the time (and associated costs) for the removal and replacement of a conveyor to as little as four hours or less.

DESCRIPTION

Figure 5:
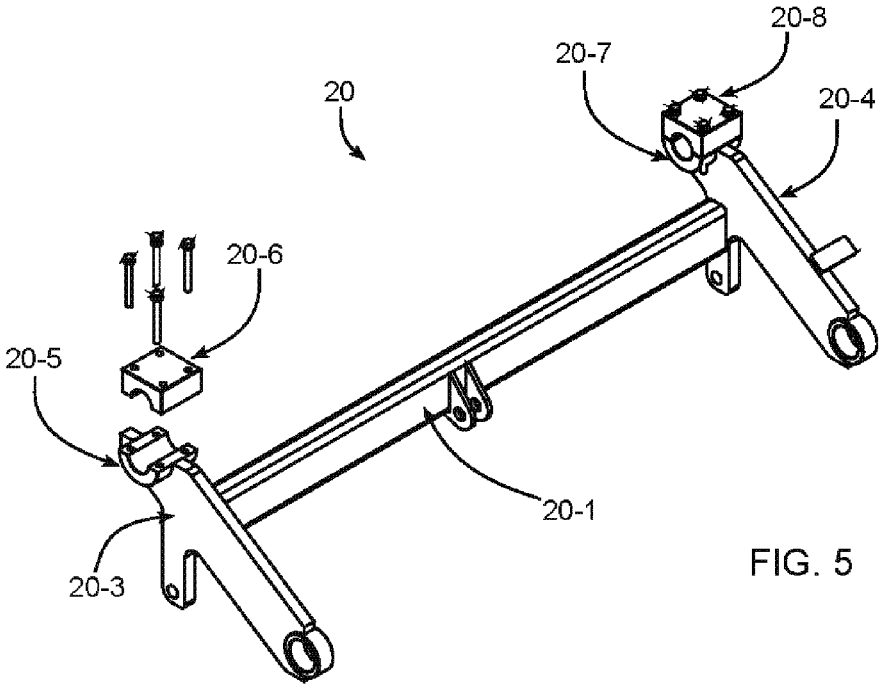
FIGS. 5 and 6 are front and rear perspective views of a cradle for mounting or holding a conveyor of the type shown in FIGS. 2 and 3.
Figure 6:
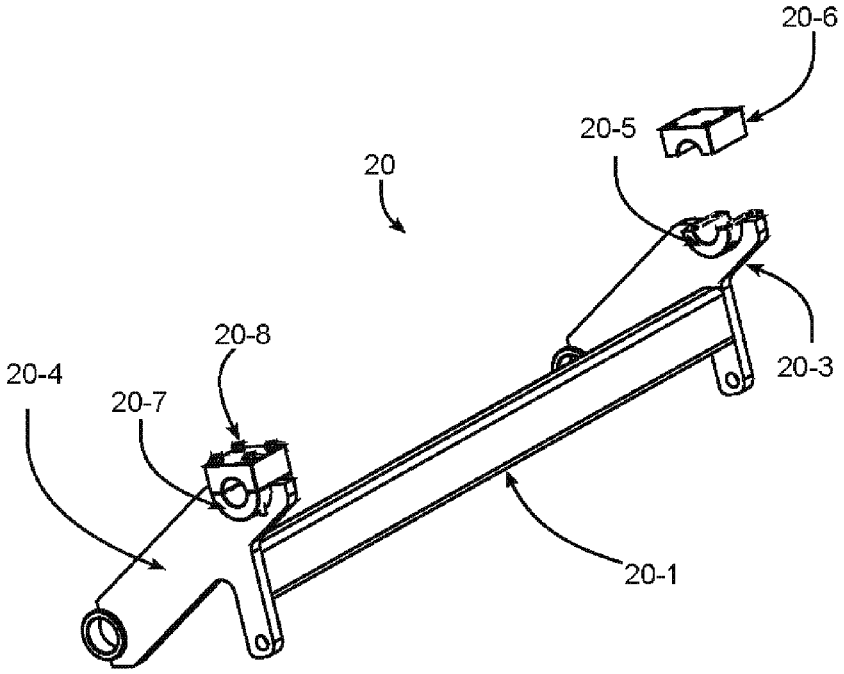

FIGS. 5 and 6 are opposite perspective views of an improved cradle 20 for receiving a conveyor 14 in a manner which facilitates the drop-in/lift-out functionality of the present invention. The cradle 20 includes a laterally aligned transverse beam 20-1 and side links 20-3 and 20-4 at opposite ends of the transverse beam 20-1. In the preferred embodiment, the cradle 20 is formed as a weldment.

Figure 1:
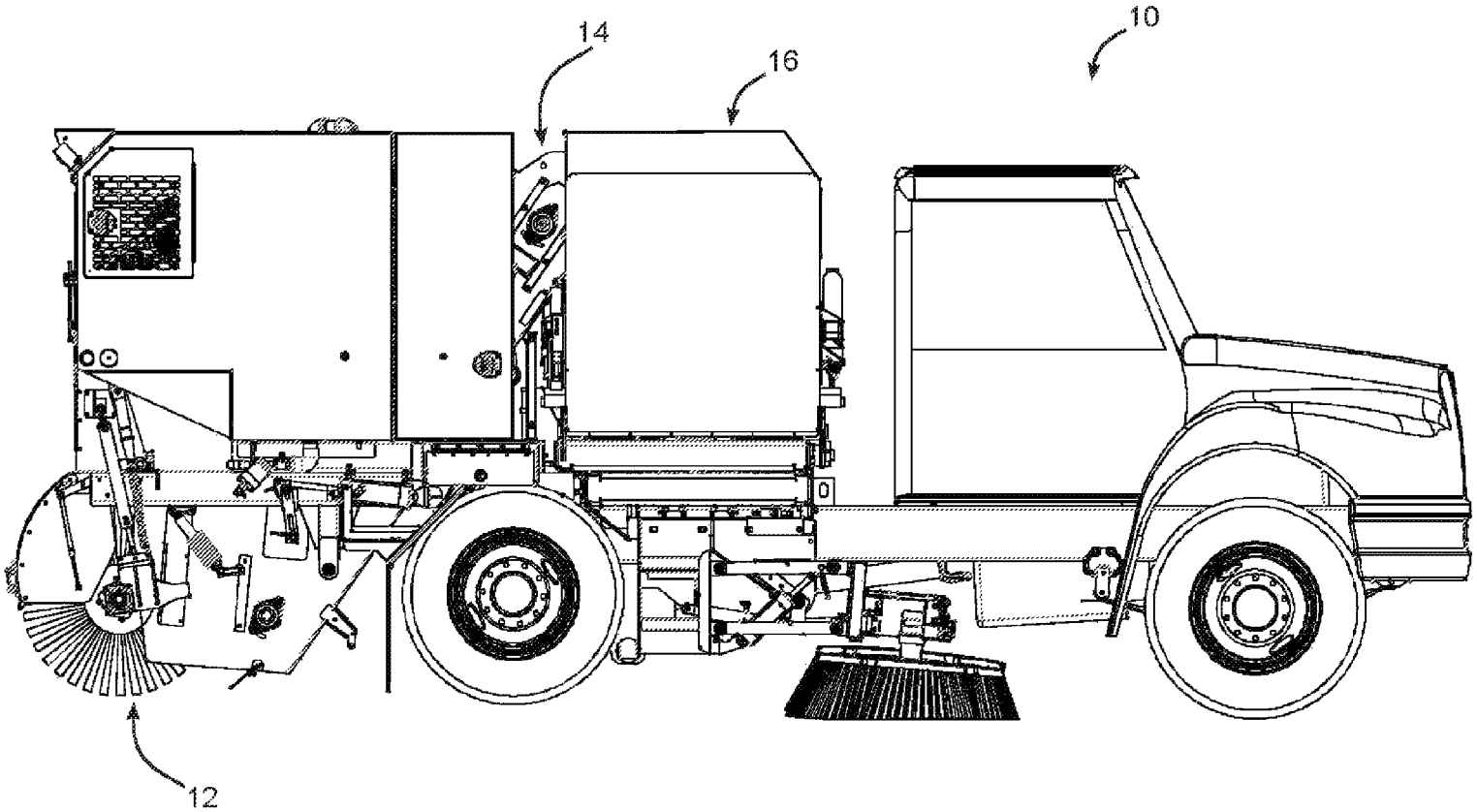
FIG. 1 PRIOR ART
FIG. 1 is a side view of representative organization of a broom-type mechanical sweeper vehicle.
Figure 3:
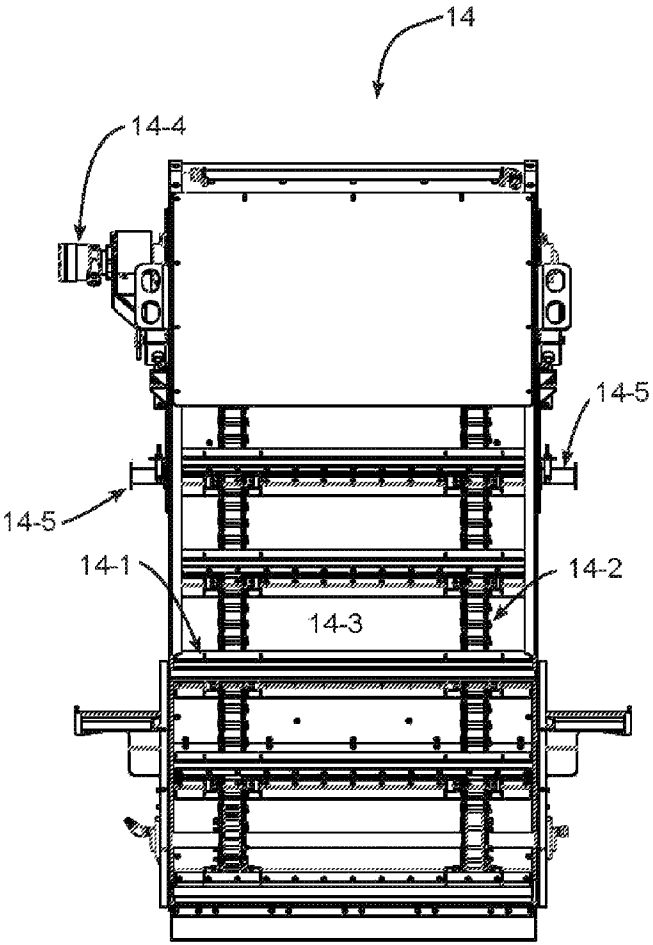
FIG. 3 PRIOR ART
FIG. 3 is a front elevational view of the conveyor of FIG. 2.
Figure 2:
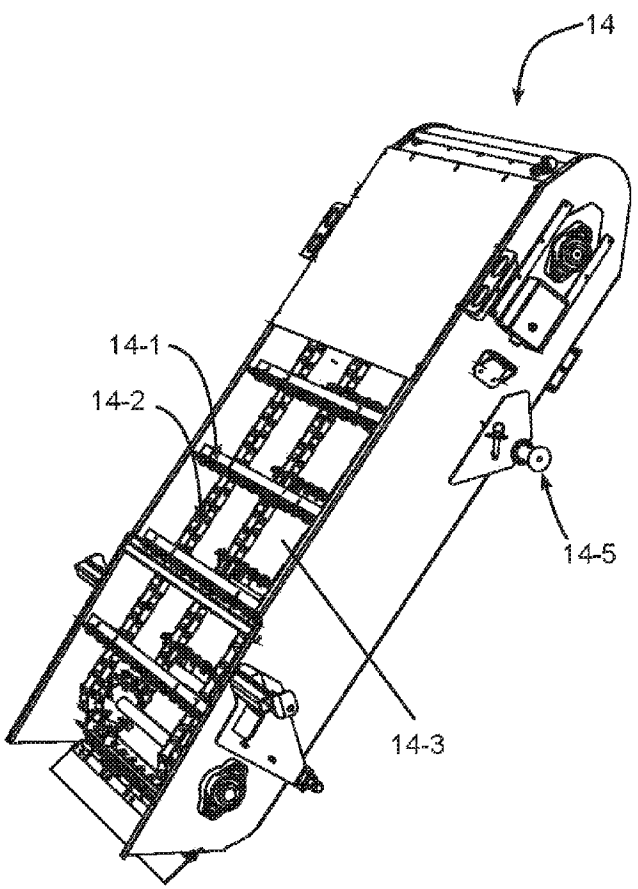
FIG. 2 PRIOR ART
FIG. 2 is a perspective view of a conveyor with selected parts removed for reasons of clarity.
Figure 4:
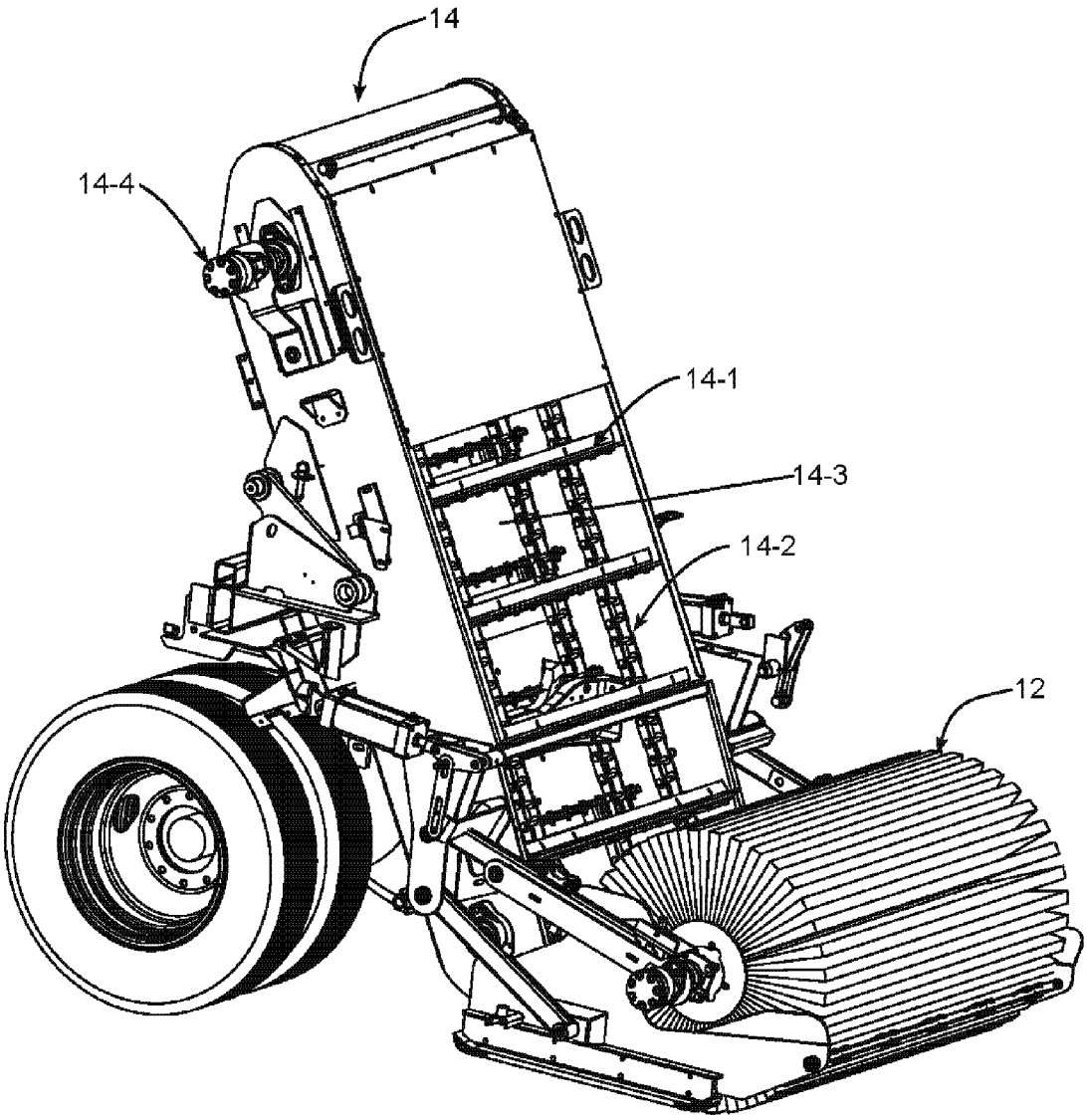
FIG. 4 PRIOR ART
FIG. 4 is perspective view of the rear portion of a broom-type mechanical sweeper vehicle with selected parts omitted for reasons of clarity and showing the conveyor aft of the rear axle and a rotatable broom aft of the conveyor.

Each side link, 20-3 and 20-4, includes a split pillow-block formation at their uppermost portions. The side link 20-3 includes a semi-cylindrical portion 20-5 and a matching cap 20-6 that are held together by threaded fasteners (unnumbered) to define a bore (unnumbered) having a diameter sufficient to accept a stub shaft 14-5 (FIGS. 2 and 3) with a clearance fit to effectively journal the stub shafts 14-5 for limited pivoting motion. In a similar manner, the side link 20-4 includes a semi-cylindrical portion 20-7 and a matching cap 20-8 held together by threaded fasteners (unnumbered) to define a bore (unnumbered) having a diameter sufficient to accept a stub shaft 14-5 (FIGS. 2 and 3) with a clearance fit to effectively journal the stub shafts 14-5 for limited pivoting motion.

Figure 7:
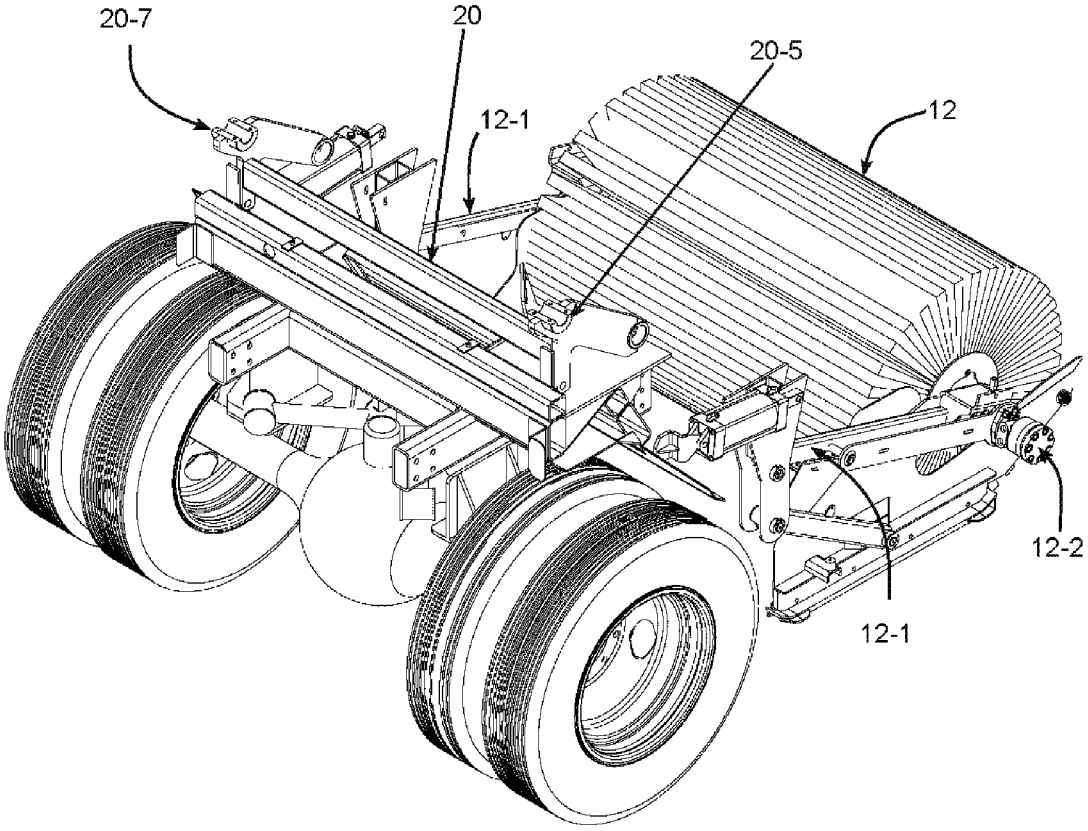
FIG. 7 is a rear perspective view of FIG. 4 with the conveyor removed for reasons of clarity.
Figure 8:
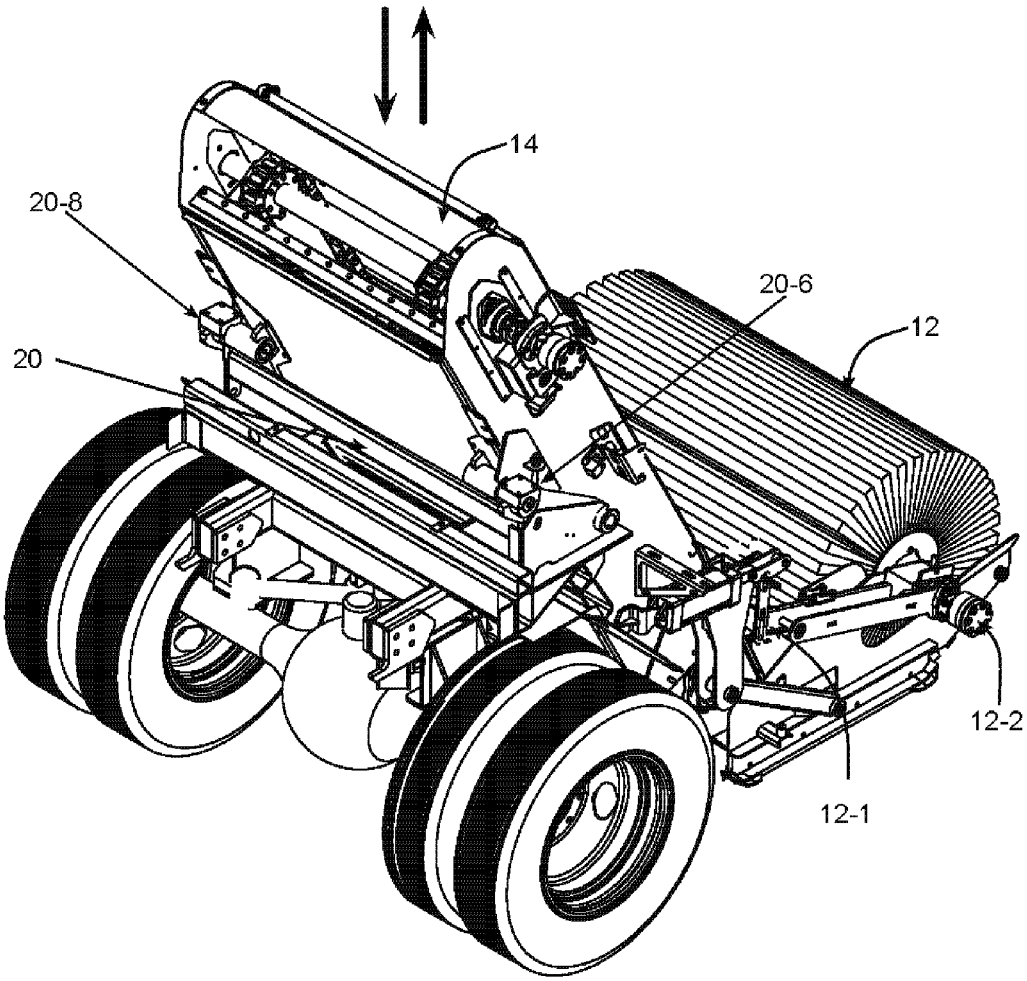
FIG. 8 is a rear perspective view showing the conveyor mounted or installed in its cradle.

FIG. 7 is a rear perspective of a number of structural components aft of the rear axle of the vehicle, including the rotatable broom 12, its trailing arms 12-1, its drive motor 12-2, and the cradle 20 of FIGS. 5 and 6 mounted to a structural organization (unnumbered) connected to the vehicle frame. As shown in FIG. 7, the caps 20-6 and 20-8 have been omitted to more clearly show the semi-cylindrical portions 20-5 and 20-7. The volumetric space aft of the cradle 20 and forward of the broom 12 is designed to receive the conveyor 14. As shown in FIG. 8, the conveyor 14 is received within the volumetric space aft of the cradle 20 and forward of the broom 12 with a stub shafts 14-5 received within each split pillow block formation 20-5 and 20-7 and retained in place with a respective cap 20-6 and 20-8 and threaded fasteners.

As represented by the two parallel oppositely directed arrows, the conveyor 14 can be lifted in the vertical direction when the caps 20-6 and 20-8 are removed and all other connection members (i.e., links, pivots, hydraulic connections, electrical connections, etc.) and any other overlying structures (panels, links, etc.) that would interfere with lifting of the conveyor from the vehicle or installing a conveyor are removed. The mechanized broom sweeper vehicle described herein is merely representative; as can be appreciated, vehicles from various manufacturers will vary in the details of the various links, pivots, hydraulic, electrical, etc. connections that must be disconnected and the various overlying structures to be removed prior to lifting the conveyor 14 from the vehicle.

Figure 9:
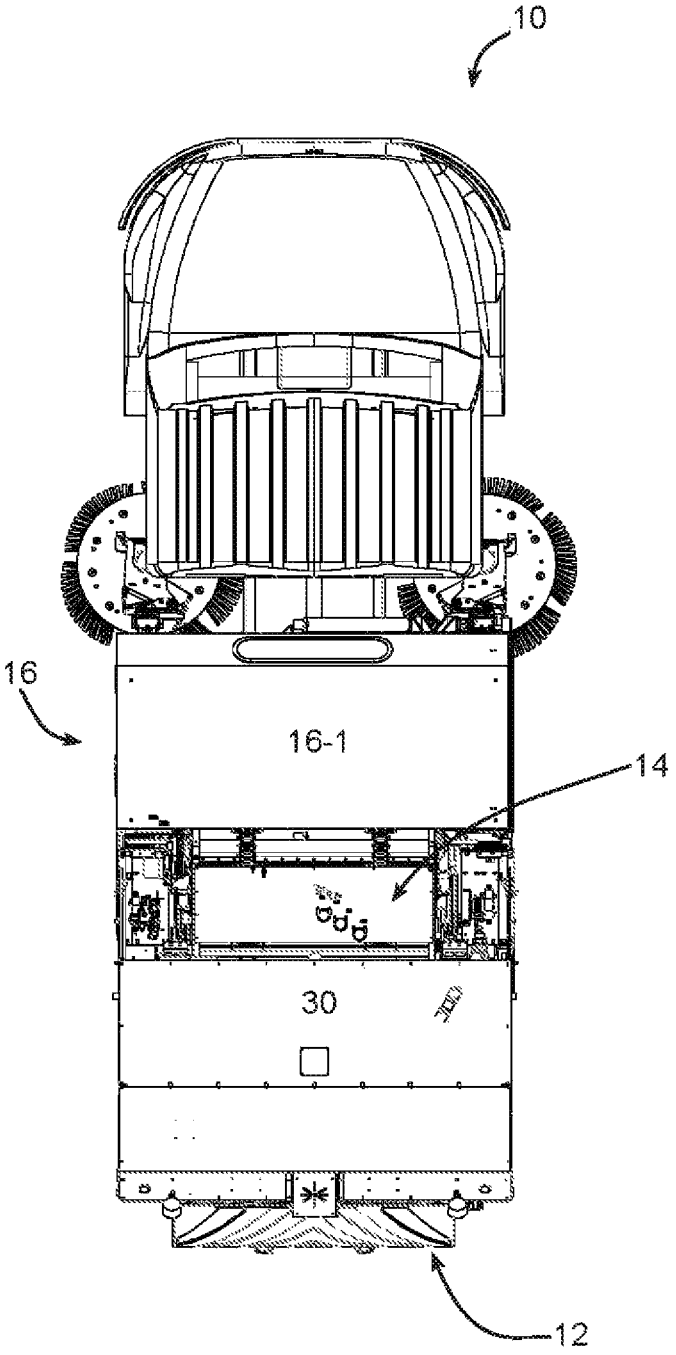
FIG. 9 is a top view of the broom-type mechanical sweeper vehicle.

As shown in FIG. 9, the sweeper vehicle is prepared for removal of the conveyor 14 by removing the top panel 16-1 (or panels) of the debris hopper 16. In a similar manner, the top panel 30 (or panels) for the enclosure aft of the conveyor 14 is removed. Likewise, any structures superposed above the conveyor 14 (not shown) are similarly removed. Thereafter, the caps 20-6 and 20-8 are removed to effectively release the stub shafts 14-5. Additionally, all links, pivots, and attachments are disconnected from the conveyor 14 and all electrical connectors are disconnected.

Figure 10:
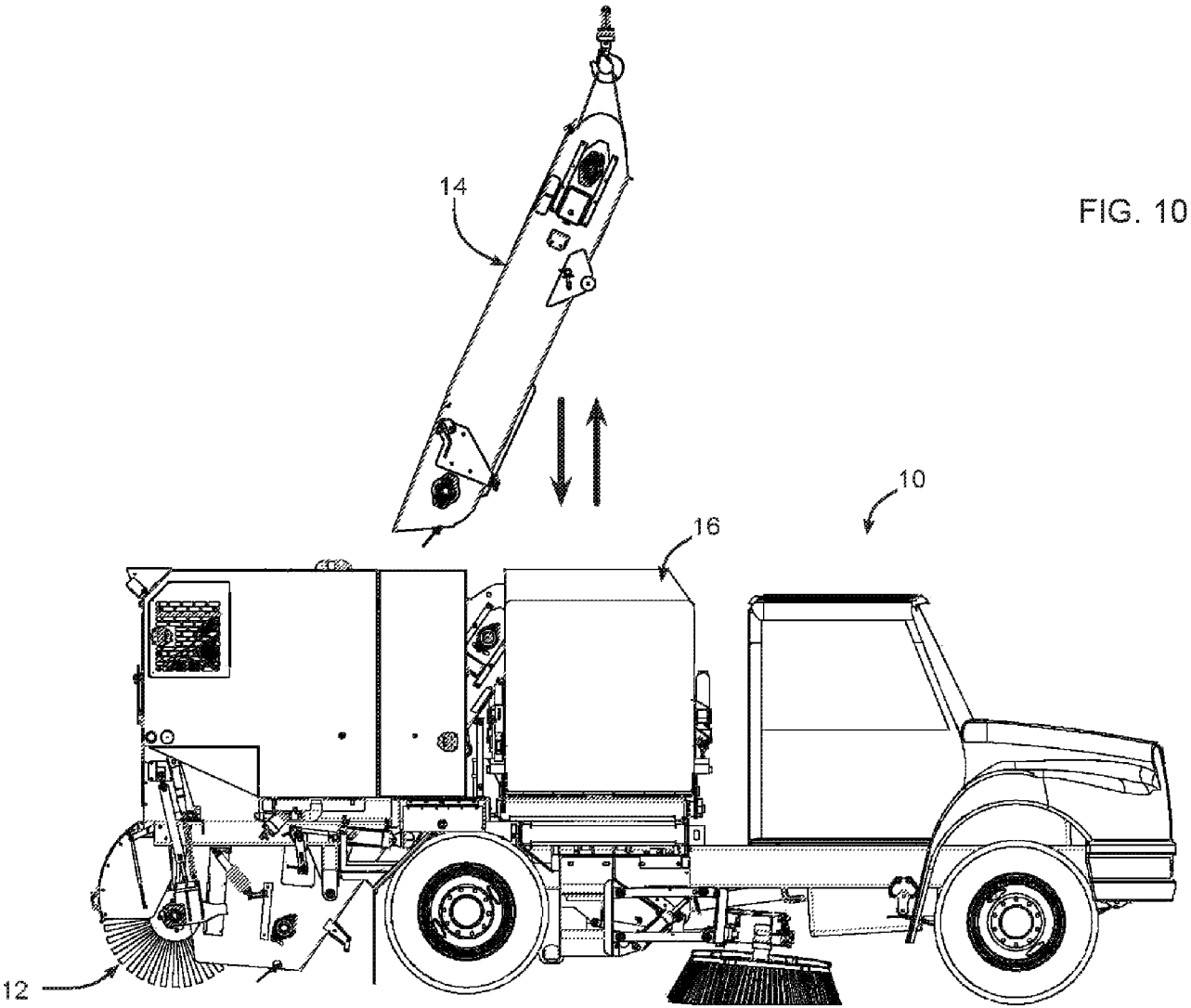
FIG. 10 is a side view of the broom-type mechanical sweeper vehicle of FIG. 1 showing a conveyor above the vehicle carried by an overhead crane.

As shown in FIG. 10, the conveyor 14 is lifted out of the vehicle by an overhead crane of some type. As can be appreciated, a replacement conveyor 14 is installed into the vehicle via the overhead crane and the caps 20-6 and 20-8 re-installed with all links, pivots, attachments, fluidic (hydraulic and/or pneumatic), electrical cables re-connected to the conveyor 14 and all overlying structures re-installed to complete the remove and install process.

In general, the system and method of the disclosed subject matter results in a significant reduction in the total time require to remove and replace a conveyor.

As will be apparent to those skilled in the art, various changes and modifications may be made to the illustrated embodiment without departing from the spirit and scope of the invention as determined by the appended claims and their legal equivalent.

The invention claimed is:

1. A method for removing a conveyor from a mechanical broom sweeper vehicle from the top of the vehicle, the mechanical broom sweeper of the type having a rotatable roadway-engaging broom and a debris conveyor mounted aft of the rear axle of the vehicle and having a cradle for carrying the conveyor at a predetermined angle relative to the roadway, the conveyor having first and second stub shafts, a first stub shaft extending laterally outward from a first side of the conveyor and a second stub shaft extending laterally outward from a second side of the conveyor, the first and second stub shafts coaxial with a common axis, comprising the steps of:

mounting the first and second stub shafts in respective first and second stub shaft receiving formations, each formation having a first part connected to the vehicle and having a semi-cylindrical surface receiving its respective stub shaft and having a second removable part having a semi-cylindrical surface, the second removable part and the first part removeably secured together so that the semi-cylindrical surfaces define a bore for receiving its respective stub shaft;

removing each second removeable part from its respective first part;

disconnecting any mechanical connections to the conveyor;

removing any structures on the sweeper vehicle superposed above the conveyor and interfering with lifting the conveyor vertically from the sweeper vehicle; and lifting the conveyor from the vehicle to effect removal therefrom.

2. A method for removing and replacing a conveyor from a mechanical broom sweeper vehicle from the top of the vehicle, the mechanical broom sweeper of the type having a rotatable roadway-engaging broom and a debris conveyor mounted aft of the rear axle of the vehicle and having a cradle for carrying the conveyor at a predetermined angle relative to the roadway, the conveyor having first and second stub shafts, a first stub shaft extending laterally outward from a first side of the conveyor and a second stub shaft extending laterally outward from a second side of the conveyor, the first and second stub shafts coaxial with a common axis, comprising the steps of:

mounting the first and second stub shafts in respective first and second tub shaft receiving formations, each formation having a first part connected to the vehicle and having a semi-cylindrical surface receiving its respective stub shaft and having a second removable part having a semi-cylindrical surface, the second removable part and the first part removeably secured together so that the semi-cylindrical surfaces define a bore for receiving its respective stub shaft;

removing each second removeable part from its respective first part;

disconnecting any mechanical connections to the conveyor;

removing any structures on the sweeper vehicle superposed above the conveyor and interfering with lifting the conveyor vertically from the sweeper vehicle;

lifting the conveyor from the vehicle to effect removal therefrom;

lowering a conveyor into the vehicle so that each first part receives its respective stub shaft; and re-installing each respective second removeable part.

3. The method of claim 2, further comprising the step of re-installing any structures removed from the sweeper vehicle in the removing step.

4. A system for mounting a debris conveyor in a mechanized broom sweeper vehicle, the mechanical broom sweeper of the type having a having a rotatable roadway-engaging broom and a debris conveyor mounted aft of the rear axle of the vehicle, the debris conveyor mounted between the roadway-engaging broom and the rear axle of the vehicle, comprising:

a first stub shaft extending laterally outward from a first side of the conveyor;

a second stub shaft extending laterally outward from a second side of the conveyor, the first and second stub shafts coaxial along a common axis;

first and second stub shaft receiving formations, each formation having a first part connected to the vehicle and having a semi-cylindrical surface for receiving its stub shaft and having a second removable part having a semi-cylindrical surface, the second removable part and the first part removeably secured together so that the semi-cylindrical surfaces define a bore for receiving its respective stub shaft;

the second removeable parts selectively removeable from the respective first parts to present the stub shafts and the conveyor for removal from the first part formations in a substantially vertical direction.

5. The system of claim 4, further comprising:

a cradle connected to the vehicle for receiving the debris conveyor, the cradle having first and second lateral sides, each lateral side thereof having a respective one of the first and second parts of the stub shaft receiving formations.

6. The system of claim 5, wherein the cradle is formed as a weldment.

* * * * *